US006006438A

United States Patent [19]

Shrider

[11] Patent Number: 6,006,438

[45] Date of Patent: Dec. 28, 1999

[54] AUTOMATED FEED ASSEMBLY FOR USE WITH A PACK SEAL TESTER

[75] Inventor: Van E. Shrider, Macon, Ga.

[73] Assignee: Brown & Williamson Tobacco Corporation, Louisville, Ky.

[21] Appl. No.: 09/046,074

[22] Filed: Mar. 23, 1998

[51] Int. Cl.[6] ..... B26D 5/20

[52] U.S. Cl. ..... 33/626; 33/613; 83/282

[58] Field of Search ..... 33/533, 613, 626, 33/644, 645; 83/282, 268, 468.6, 919, 931; 73/756, 755

[56] References Cited

U.S. PATENT DOCUMENTS

| | | | |
|---|---|---|---|
| 2,991,879 | 7/1961 | Innocenti | 209/31 |
| 3,956,110 | 5/1976 | Seragnoli | 209/31 |
| 3,991,605 | 11/1976 | Reuland | 73/38 |
| 4,603,611 | 8/1986 | Ferguson | 83/50 |
| 4,643,027 | 2/1987 | Deutsch et al. | 73/865.8 |
| 4,814,072 | 3/1989 | Von Wichert et al. | 209/535 |
| 4,972,494 | 11/1990 | White et al. | 382/143 |
| 5,101,609 | 4/1992 | Cook | 53/53 |
| 5,306,115 | 4/1994 | Montalvo et al. | 414/797.9 |
| 5,383,322 | 1/1995 | Collins, Jr. et al. | 53/53 |

FOREIGN PATENT DOCUMENTS

| | | | |
|---|---|---|---|
| 152518 | 11/1981 | Japan | 83/468.6 |

*Primary Examiner*—Andrew Hirshfeld
*Assistant Examiner*—R. Alexander Smith
*Attorney, Agent, or Firm*—Middleton & Reutlinger; John F. Salazar

[57] ABSTRACT

The present invention relates to an automated feed assembly for use with a pack seal tester. The automated feed assembly receives a plurality of cigarette packs into a testing column for advancement control of the packs to the tester. The automated feed assembly adjusts the flow of cigarette packs within the testing column through the use of a first, second and third push and hold mechanism which work in conjunction with a first and a second stop mechanism, all of which work in conjunction with each other to orderly advance the packs to a plunger and vacuum source for testing the seal strength of the cigarette pack seal.

5 Claims, 6 Drawing Sheets

AUTOMATED FEED ASSEMBLY FOR USE WITH A PACK SEAL TESTER

BACKGROUND OF THE INVENTION

1. Technical Field of the Invention

The present invention relates to an automated feed assembly for use with a manually-operated pack seal tester. More particularly, the present invention relates to an automated feed assembly for use with a manually-operated pack seal tester, wherein a plurality of sealed packs are stacked therein and advanced therethrough under the influence of gravity.

2. Description of the Related Art

Packages of cigarettes are often wrapped with a transparent film of polyethylene or other similar material to preserve freshness of the cigarettes contained therein. The manufacturing, assembly and wrapping of the cigarette packages is oftentimes performed at high rates of speed. It is therefore imperative that the wrapped cigarette packages be closely monitored to ensure that they conform to preselected quality control standards.

One such specification, such as, for example, the integrity of the freshness seal provided by the wrapping, is monitored by an operator's periodically removing a sample cigarette package from those being produced and testing the seal integrity with a manual pack seal tester. Typically, a small perforation is made through the wrapping and a vacuum is drawn therethrough so that an interior region of the wrapping is subjected to an inwardly-directed vacuum having a predetermined force. The sample cigarette package passes the quality control test if the wrapping withstands the force of the vacuum and is not destroyed thereby. It is therefore desirable to provide an automated feed assembly for feeding a plurality of packages of wrapped cigarettes to a pack seal tester.

For example, U.S. Pat. No. 2,991,879 to Innocenti teaches a sealed-package wrapper end tester having mechanical plungers to transport cigarette packages between two parallel channel systems along a horizontal panel. However, it is further desirable to provide an automated feed assembly for feeding a plurality of packages of wrapped cigarettes to a pack seal tester, wherein the plurality of cigarette packages are vertically advanced through the automated test assembly under the influence of gravity.

For example, U.S. Pat. No. 4,814,072 to Von Wichert, et al., teaches an apparatus for intermittently moving a plurality of stacks of cigarette packages along a horizontal path, wherein the stacks are fed onto the horizontal path by a vertical elevator assembly. However, it is further desirable to provide an automated feed assembly for feeding a plurality of packages of wrapped cigarettes to a pack seal tester, wherein the automated feed assembly includes an automated testing apparatus attached thereto.

BRIEF SUMMARY OF THE INVENTION

It is an object of the present invention to provide an automated feed assembly for feeding a plurality of packages of wrapped cigarettes to a pack seal tester.

It is another object of the present invention to provide an automated feed assembly for feeding a plurality of packages of wrapped cigarettes to a pack seal tester, wherein the plurality of cigarette packages are vertically advanced through the automated test assembly under the influence of gravity.

It is yet another object of the present invention to provide an automated feed assembly for feeding a plurality of packages of wrapped cigarettes to a pack seal tester, wherein the automated feed assembly includes an automated testing apparatus attached thereto.

An automated feed assembly according to the present invention for use with a pack seal tester includes a vertical testing column having a plurality of sides defining a feed channel therethrough, the testing column having an open upper end being in communication with the feed channel and an open lower end being in communication with the feed channel; a first push and hold mechanism mounted to one side of the testing column, the first push and hold mechanism having a first plunger being in horizontal reciprocating communication with the feed channel; a second push and hold mechanism being mounted to one side of the testing column vertically below the first push and hold mechanism, the second push and hold mechanism having a second plunger being in horizontal reciprocating communication with the feed channel; a punch mechanism mounted to one side of the testing column opposite the second push and hold mechanism, the punch mechanism having a punch die being in horizontal reciprocating communication with the feed channel; a first stop mechanism mounted to one side of the testing column vertically below the punch mechanism, the first stop mechanism having a first arm pivotally mounted thereto, the first arm being in horizontal reciprocating communication with the feed channel; a third push and hold mechanism mounted to one side of the testing column vertically below the first stop mechanism, the third push and hold mechanism having a third plunger being in horizontal reciprocating communication with the feed channel; and, a second stop mechanism mounted to one side of the testing column vertically below the third push and hold mechanism, the second stop mechanism having a second arm pivotally mounted thereto, the second arm being in horizontal reciprocating communication with the feed channel.

BRIEF DESCRIPTION OF THE SEVERAL VIEWS OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
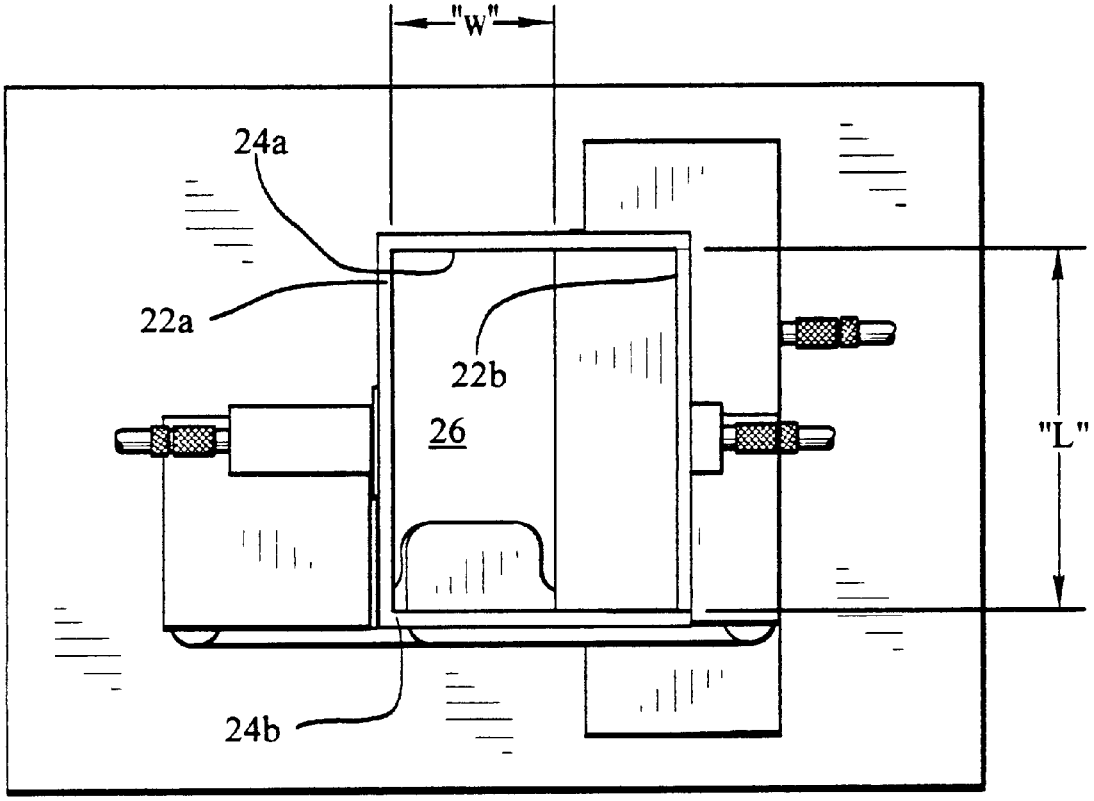
FIG. 1 is a top view of an automated feed assembly for use with a pack seal tester according to a preferred embodiment of the present invention.
Figure 2:
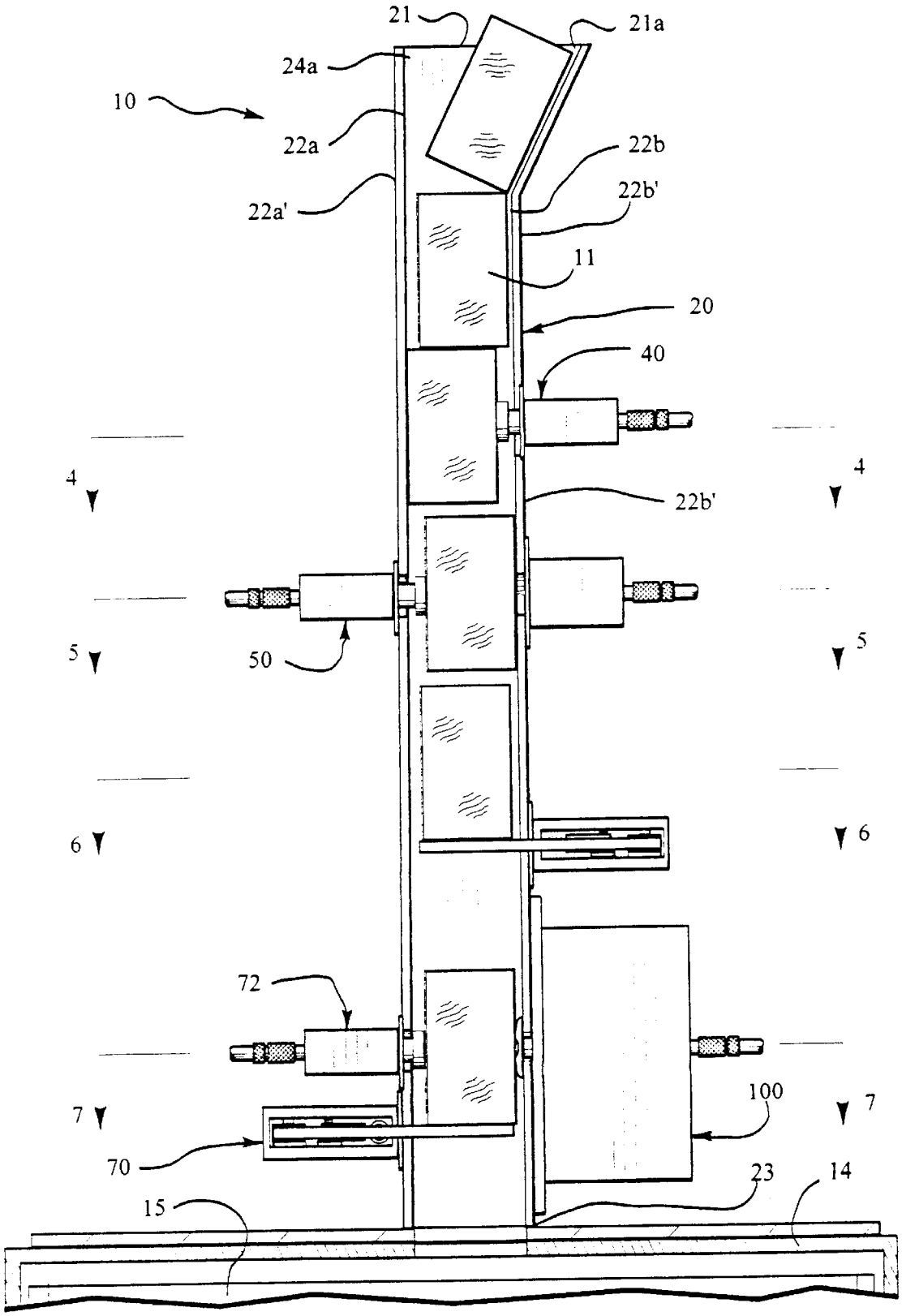
FIG. 2 is a side view of the automated feed assembly of FIG. 1, shown having portions thereof removed.

With reference to FIGS. 1 and 2, a feed assembly 10 is provided according to a preferred embodiment of the present invention to which a pack seal tester 100 is removably mounted, such, as, for example, by bolts. The pack seal tester 100 is a commercially-available product, such as, for example, an Arjay Pack Seal Tester manufactured by Fidus Corporation. The feed assembly 10 is positioned relative to the pack seal tester 100 to feed a plurality of sealed packages 11, such as, for example, a package of cigarettes, to the pack seal tester 100 for testing the integrity of a film wrapper 12 (FIG. 5) provided around the packages 11, wherein gravity is used as a means of advancing the packages 11 through the feed assembly 10 and to the pack seal tester 100. The feed assembly may be mounted onto a discharge bin 14 for receiving and containing the packages 11 after being tested. The discharge bin 14 may include a drawer 15 slidingly received thereby which permits an operator to quickly unload and discard the packages 11 after being tested.

The feed assembly 10 includes a testing column 20 having opposed side walls 22*a*, 22*b* and opposed facing walls 24*a*, 24*b* defining a feed channel 26 therethrough. An open upper end 21 of the testing column 20 is provided with an flared portion 21*a* for receiving the packages 11 and feeding the packages 11 to the feed channel 26 in a sequential, stacked orientation therein. An open lower end 23 of the testing column 20 communicates with a slot (not shown) provided in an upper portion of the discharge bin 14. Thus, packages 11 are receivable through the upper end 21 of the testing column 20, vertically advanceable one-at-a-time through the feed channel 26, and dischargeable into the discharge bin 14 through the lower end 23 of the testing column 20.

The side walls 22*a*, 22*b* are dimensioned to permit packages 11 of varying sizes to be advanceable therethrough. For example, opposed facing walls 24*a*, 24*b* typically define a length "L" therebetween to receive packages 11 having varying lengths, such as, for example, cigarette packages having cigarette 84's, 100's or 120's therein, all of which have a unique length. Even further, opposed side walls 22*a*, 22*b* typically define a width "w" therebetween to receive packages 11 having varying widths, such as, for example, cigarette packages having cigarette regulars or slims therein, both of which have a unique diameter, contributing to a unique package width.

Figure 3:
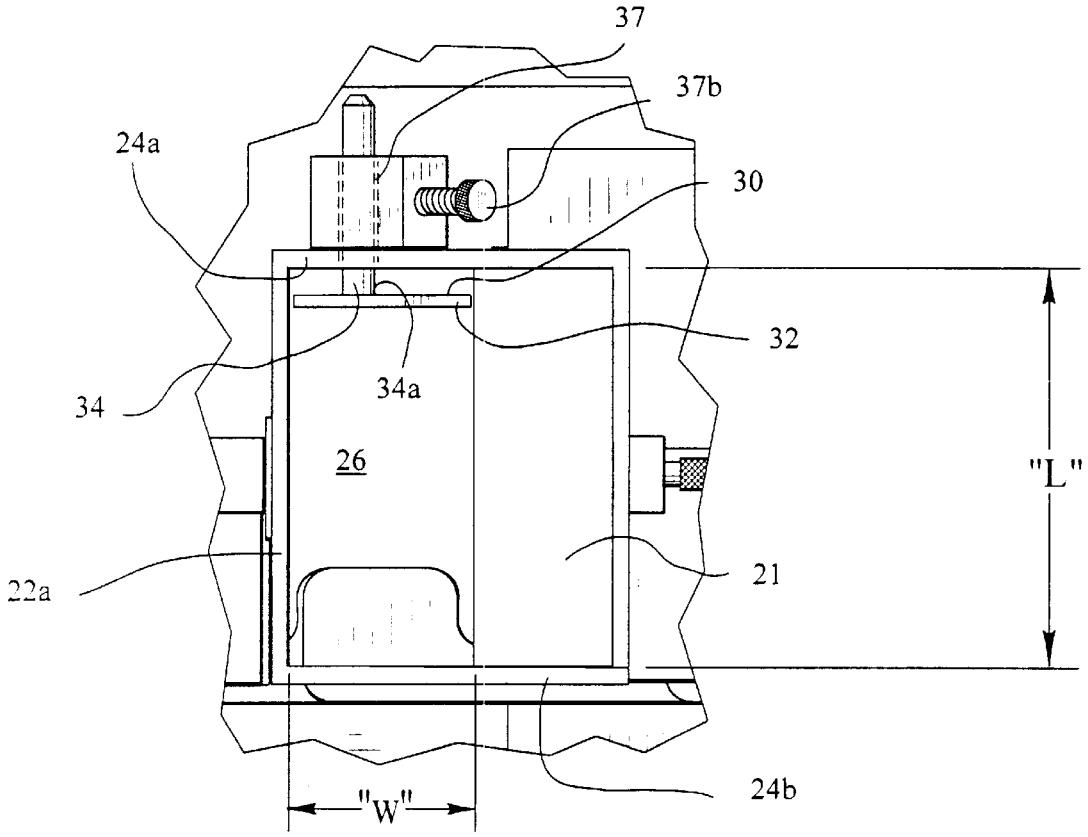
FIG. 3 is a detail top view of one component of the automated feed assembly of FIG. 1.

With reference to FIG. 3, the testing column 20 may be provided with adjustment means 30 (not shown in FIGS. 1, 2, 4–9) adjustably connected thereto for manually adjusting either the length "L" between opposed facing walls 24*a*, 24*b* or the width "w" between opposed side walls 22*a*, 22*b*. For example, adjustment means 30 may be provided to adjust the operational length L of the feed channel 26 and includes a vertical plate 32 slidingly received within the feed channel 26 substantially parallel to facing wall 24*a* and adjustably connected thereto by a pair of rods fixedly attached at one end (only rod 34 and its end 34*a* are shown) thereof to the vertical plate 32. Facing wall 24*a* is provided with a pair of bores (not shown) sized and positioned to slidingly receive the rods respectively, therethrough. A pair of block members (only block member 37 is shown) are fixedly attached to the outer surface of the facing wall 24*a*, each block member having a bore (not shown) therethrough respectively disposed coaxially with the facing wall bores and being sized and positioned to slidingly receive the rods. Each of the pair of block members is provided with a locking means, (only block member 37 and its locking means 37*b* are shown) such as, for example, set screws, for frictionally locking each rod within its respective block member bore.

Adjustment of feed channel operational length L is made by loosening both locking means and sliding the vertical plate 32 either nearer to (or farther from) the facing wall 24*a* until the operational length "L" is suitable to receive the package being tested. Both locking means are then tightened, preventing the rods from translational movement within the facing wall bores and within the block member bores. Similar adjustment means (not shown) may be provided to adjust the feed channel width "w".

Figure 4:
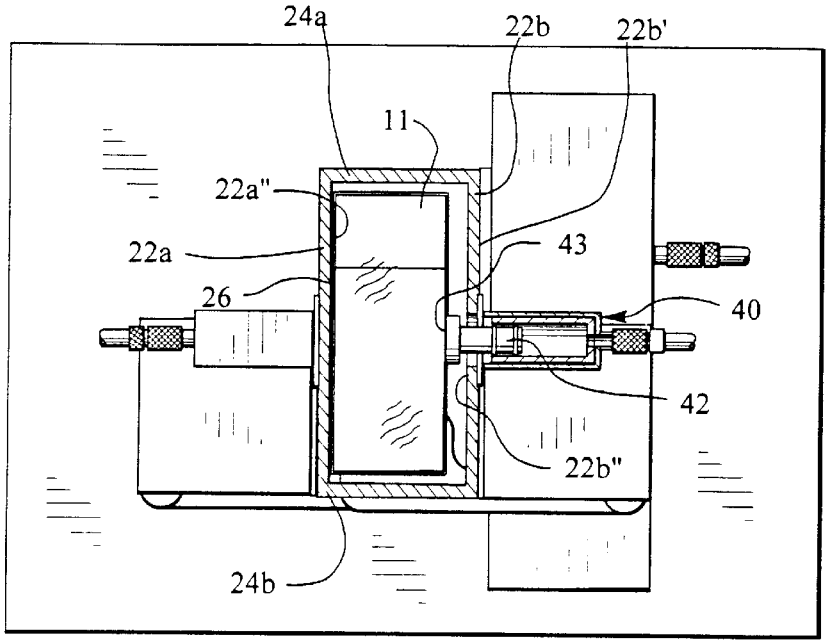
FIG. 4 is a top sectional view of the automated feed assembly of FIG. 1, shown along section line 4—4 of FIG. 2.

With combined reference to FIGS. 2 and 4, the packages 11 are held within the feed channel 26 in a vertical stack therein by a first push and hold mechanism 40 mounted to an outside surface 22*b*′ of side wall 22*b* and being in communication with the feed channel 26. More particularly, the first push and hold mechanism 40 includes a first plunger 42 being in horizontal reciprocating movement therein and having an inner face 43 normally flush with an inner surface 22*b*″ of side wall 22*b*. Upon energizing the first push and hold mechanism 40, such as, for example, by pneumatic or hydraulic pressure, the first plunger 42 extends inwardly within the feed channel 26 and contacts a package 11 disposed immediately adjacent thereto. The package 11 is pressed against an opposed inner surface 22*a*″ of side wall 22*a* and held frictionally within the feed channel 26 between the inner surface 22*a*″ of side wall 22*a* and the inner face 43 of the plunger 42. The package 11, as well as any packages stacked thereabove, are prevented from vertical downward movement within the feed channel 26, until the first push and hold mechanism 40 is de-energized.

Figure 5:
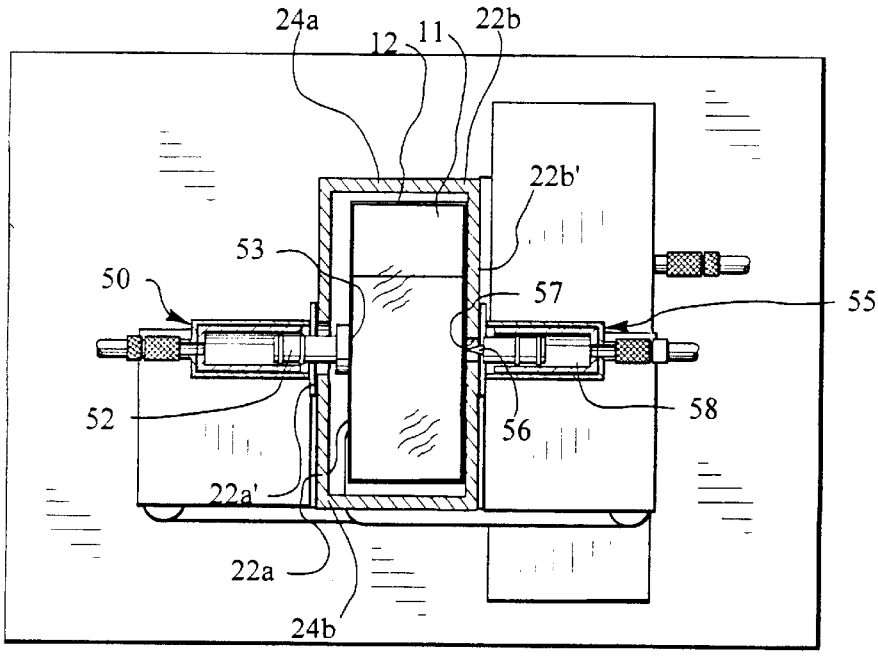
FIG. 5 is a top sectional view of the automated feed assembly of FIG. 1, shown along section line 5—5 of FIG. 2.

With additional reference to FIG. 5, the first push and hold mechanism 40 is momentarily de-energized a sufficient period of time to permit the package 11 to vertically advance downwardly to a second push and hold mechanism 50 mounted to an outside surface 22*a*′ of side wall 22*a* vertically below the first push and hold mechanism 40, wherein the second push and hold mechanism 50 is similarly in communication with the feed channel 26. The second push and hold mechanism 50 is similar in construction to the first push and hold mechanism 40 and includes a second plunger 52 being in horizontal reciprocating movement therein and having an inner face 53 normally flush with the inner surface 22*a*″ of side wall 22*a*.

As soon as the package 11 advances downwardly from the first push and hold mechanism 40 to the second push and hold mechanism 50, both push and hold mechanisms 40, 50 are energized, frictionally holding the single package 11 between an inner face 53 of the second push and hold mechanism 50 and an inner surface 22*b*″ of side wall 22*b* opposite the second push and hold mechanism 50, while frictionally holding a second package (not shown) in immediate vertical succession from the package 11 between the inner face 43 of the first push and hold mechanism 40 and the inner surface of side wall 22*a* as hereinabove described. Package 11 is thus free from influence of the weight of the second package or those packages stacked thereabove.

Figure 6:
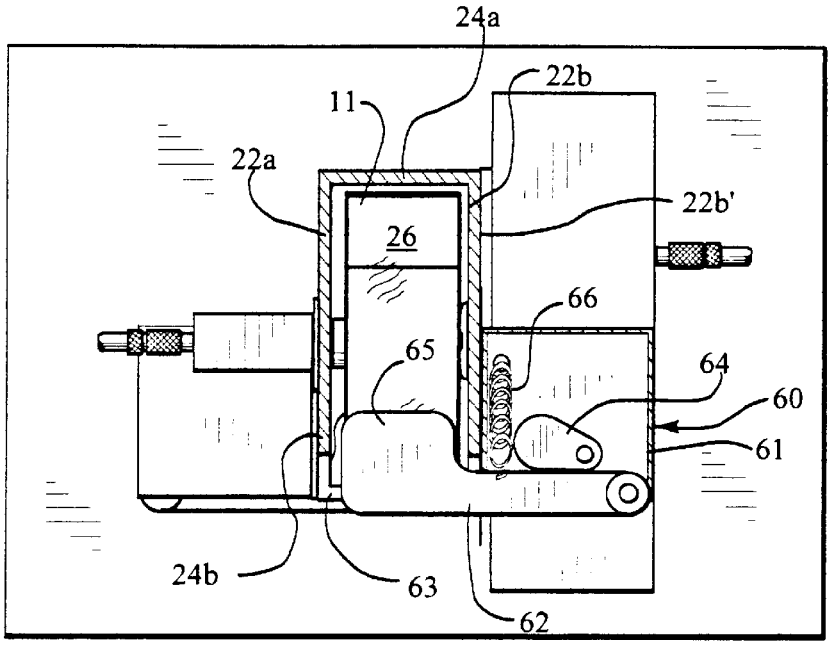
FIG. 6 is a top sectional view of the automated feed assembly of FIG. 1, shown along section line 6—6 of FIG. 2.

With additional reference to FIG. 6, a first stop mechanism 60 is mounted to the outside surface 22*b*′ of side wall 22*b* and is in reciprocating communication with the feed channel 26, such as, for example, through a slot 63 provided in side wall 22*b* and in facing wall 24*b*. The first stop mechanism 60 includes an arm 62 pivotally mounted to a housing 61 thereof and an eccentric 64 pivotally mounted to the housing 61 and in timed operational engagement with the arm 62 to reciprocally insert and withdraw a projection 65 through the slot and into the feed channel 26. The arm is biased, such as, for example, by a biasing spring 66 mounted at one end thereof to the housing 61 and mounted at another end thereof to the arm 62, to position the projection 65 in a normally inserted position within the feed channel 26. Reciprocal movement of the arm 62, and more particularly, of the projection 65, is in timed operational relationship with the first and second push and hold mechanisms 40, 50 such that the single package 11 advancing from the first push and hold mechanism 40 to the second push and hold mechanism 50 is prevented from advancing vertically downwardly beyond the first stop mechanism 60 before the second push and hold mechanism 50 has fully energized.

With reference back to FIG. 5, a punch mechanism 55 is mounted to the outside surface 22*b*′ of side wall 22*b* immediately opposite the second push and hold mechanism 50 and includes a punch die 56 being in horizontal reciprocating communication, such as, for example, though a hole 57 provided through side wall 22*b*, with the feed channel 26. A small perforation is made through the wrapping 12 of a package 11 being held against the punch mechanism 55 by the second push and hold mechanism 50. More particularly, the punch die 56 is rapidly and momentarily thrust through the wrapping 12, thereby piercing same and creating the perforation therethrough. For example, a region 58 within the punch mechanism 55 immediately behind the punch die 56 may be rapidly pressurized, such as, for example, by pneumatic or hydraulic pressure, to project the punch die 56 into the feed channel 26 and through the wrapping 12, and then de-pressurized quickly thereafter to withdraw same.

Once the perforation has been made in the package wrapping 12 and the punch die 56 has been withdrawn back into the punch mechanism 55, the second push and hold mechanism 50 is de-energized and the first stop mechanism 60 is withdrawn from the feed channel 26, thereby permitting the package 11 to advance vertically downwardly within the feed channel 26. The eccentric 64 is timed to the movement of the second push and hold mechanism 50 such that, as soon as the package 11 is positioned vertically below the projection 65, the arm 62 pivots inwardly under the influence of the biasing spring 66, thereby inserting the projection 65 into the feed channel 26. The first push and hold mechanism 40 is de-energized momentarily, thereby permitting an additional package theretofore being held thereby to vertically advance downwardly to the first stop mechanism 60, while energizing rapidly thereafter to retain additional packages situated thereabove. The second push and hold mechanism 50 is immediately energized, pressing the additional package against the punch mechanism 55, and the punching process described hereinabove is repeated.

Figure 7:
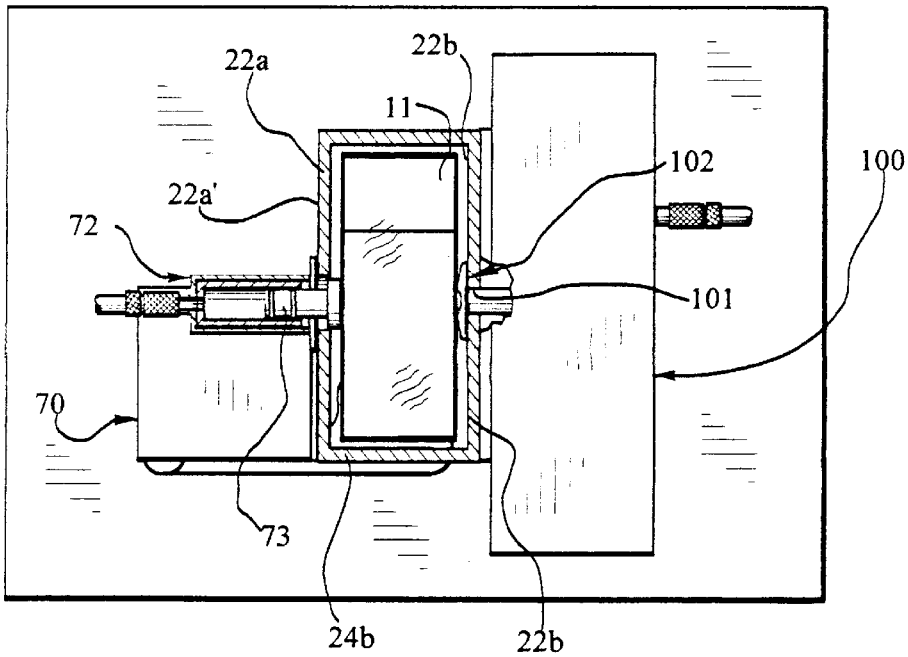
FIG. 7 is a top sectional view of the automated feed assembly of FIG. 1, shown along section line 7—7 of FIG. 2.

With combined reference to FIGS. 2 and 7, after the package 11 advances downwardly from the first stop mechanism 60, a second stop mechanism 70 mounted to the outside surface 22*b*′ of the side wall 22*a* positions the package 11 vertically within the feed column 26 between a third push and hold mechanism 72 and the pack seal tester 100. The second stop mechanism 70 is similar in construction to the first stop mechanism 60 and is in reciprocating communication with the feed channel 26, such as, for example, through a slot (not shown) provided in side wall 22*a* and in facing wall 24*b*. The third push and hold mechanism 72 is similar in construction to the first and second push and hold mechanisms 40, 50 and includes a third plunger 73 in horizontal reciprocating communication with the feed channel 26, such as, for example, through a hole provided in side wall 22*a* to position the package 11 firmly against the inner surface 22*b*″ of side wall 22*b*. Pack seal tester 100 is in communication, such as, for example, through a hole 101 provided in side wall 22*b*, and includes a flexible gasket 102 sized and positioned to create a seal within an outside surface of the package wrapping in a region surrounding the perforation. Sufficient vacuum pressure is drawn within the seal by the pack seal tester 100 to hold the package 11 in place thereover, at which point, the third push and hold mechanism 72 is de-energized. Additional vacuum force is drawn through the perforation to a predetermined test value to measure the integrity thereof.

Figure 8:
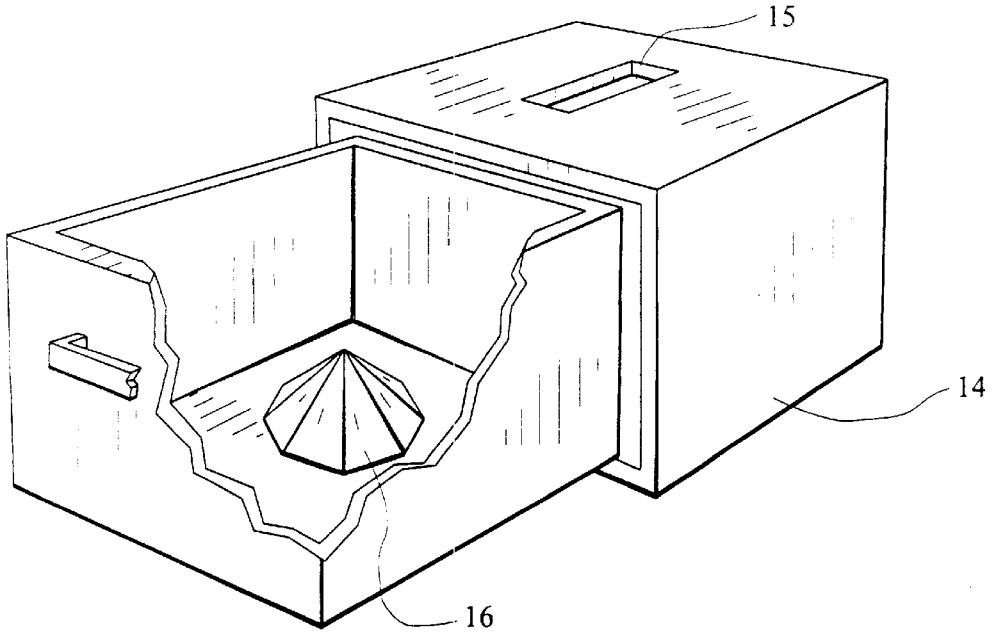
FIG. 8 is a top perspective view of one component of the automated feed assembly of FIG. 1; and, FIG. 9 is a side view of an automated feed assembly according to an alternative embodiment of the present invention.

With combined reference to FIGS. 2 and 8, the feed channel 26 is in communication with the discharge bin 14 through a slot 15 provided in an upper portion of the discharge bin 14. Following a complete testing cycle, the second stop mechanism 72 is withdrawn from the feed channel 26, thereby permitting the package 11 to fall therefrom, through the slot 15 and into the discharge bin 14. A deflector 16 may be provided on a lower surface of the discharge bin 16 to prevent accumulation of discharged packages from an area immediately below the testing column 20.

Figure 9:
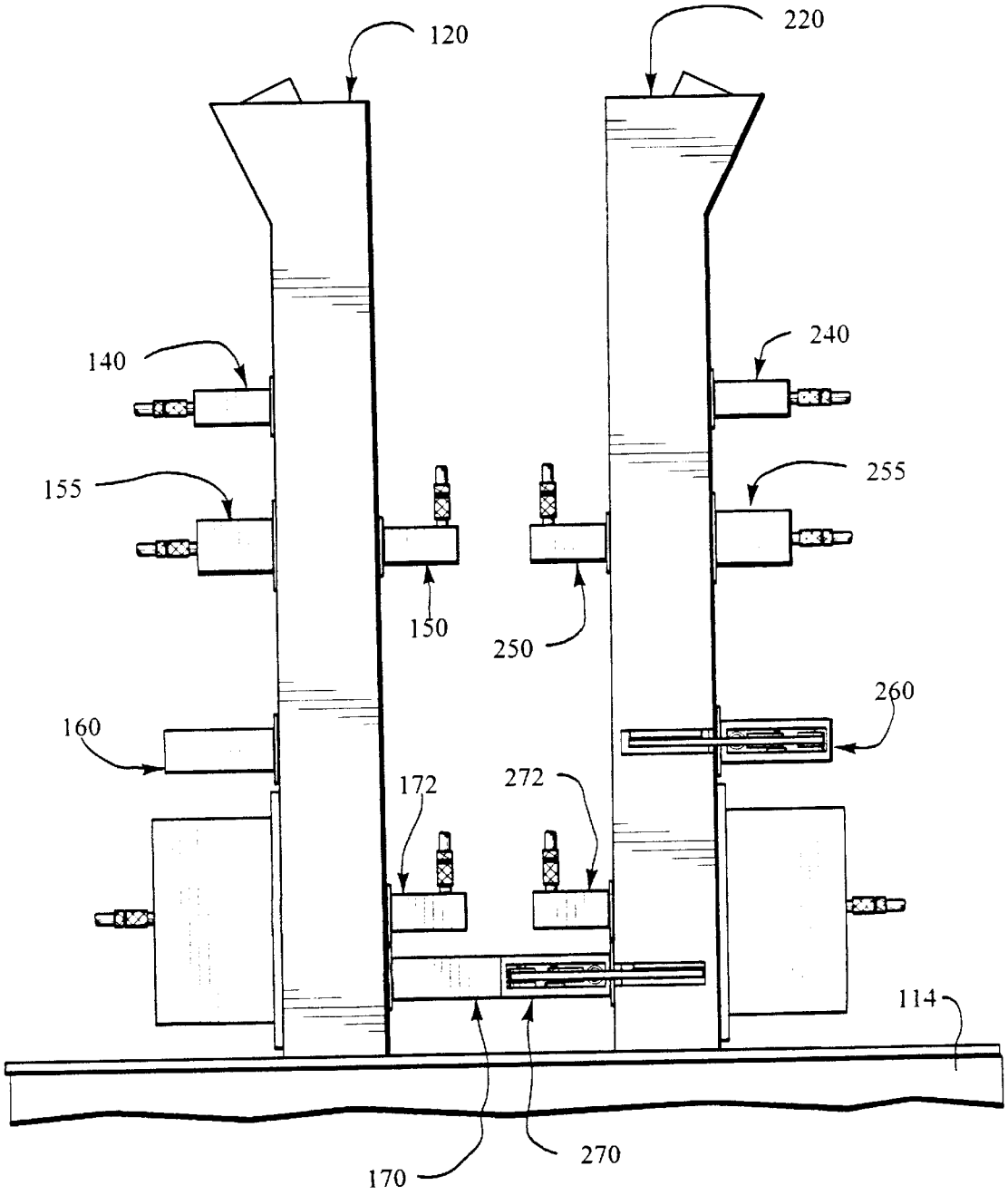

With reference to FIG. 9, an alternative embodiment of the present invention includes two or more testing columns 120, 122 as hereinabove described mounted in proximity to one another to the discharge bin 114, thereby permitting simultaneous testing of packages having different lengths and widths.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. An automated feed assembly for use with a pack seal tester, comprising:

a vertical testing column having a plurality of sides defining a feed channel therethrough, said testing column having an open upper end being in communication with said feed channel and an open lower end being in communication with said feed channel;

a first push and hold mechanism mounted to one side of said testing column, said first push and hold mechanism having a first plunger being in horizontal reciprocating communication with said feed channel;

a second push and hold mechanism being mounted to one side of said testing column vertically below said first push and hold mechanism, said second push and hold mechanism having a second plunger being in horizontal reciprocating communication with said feed channel;

a punch mechanism mounted to one side of said testing column opposite said second push and hold mechanism, said punch mechanism having a punch die being in horizontal reciprocating communication with said feed channel;

a first stop mechanism mounted to one side of said testing column vertically below said punch mechanism, said first stop mechanism having a first arm pivotally mounted thereto, said first arm being in horizontal reciprocating communication with said feed channel;

a third push and hold mechanism mounted to one side of said testing column vertically below said first stop mechanism, said third push and hold mechanism having a third plunger being in horizontal reciprocating communication with said feed channel; and, a second stop mechanism mounted to one side of said testing column vertically below said third push and hold mechanism, said second stop mechanism having a second arm pivotally mounted thereto, said second arm being in horizontal reciprocating communication with said feed channel.

2. The automated feed assembly of claim 1, further comprising adjustment means mounted to one side of said testing column for adjusting the width of said testing column.

3. The automated feed assembly of claim 2, said adjustment means comprising:

an adjuster plate being slidingly receivable within said feed channel, said adjuster plate having a shape substantially similar to one side of said testing column:

at least one rod fixedly attached at one end thereof to a first side of said adjuster plate, said at least one rod being slidingly receivable by a hole provided through said testing column; and, a block member fixedly attached to an outer surface of said testing column, said outer surface being opposite said feed channel, said block member having a bore therethrough, said bore being coaxial with said hole through said testing column and being slidingly receivable by said at least one rod, said block member having locking means for preventing slidingly movement of said rod through said block member bore.

4. The automated feed assembly of claim 1, said first stop mechanism further comprising:

a first eccentric pivotally mounted thereto, said first eccentric being in timed operational relationship with said first arm; and, a first biasing spring mounted at one end thereof to said first stop mechanism, said first biasing spring being mounted at another end thereof to said first arm.

5. The automated feed assembly of claim 1, said second stop mechanism further comprising:

a second eccentric pivotally mounted thereto, said second eccentric being in timed operational relationship with said second arm; and, a second biasing spring mounted at one end thereof to said second stop mechanism, said second biasing spring being mounted at another end thereof to said second arm.

* * * * *